US012016511B2

(12) United States Patent
Engelhart et al.

(10) Patent No.: US 12,016,511 B2
(45) Date of Patent: Jun. 25, 2024

(54) DOMESTIC DISHWASHER

(71) Applicant: BSH Hausgeräte GmbH, Munich (DE)

(72) Inventors: Matthias Engelhart, Ulm (DE); Klaus Dukek, Weißenhorn (DE); Manuel Balzer, Gersthofen (DE)

(73) Assignee: BSH Hausgeräte GmbH, Munich (DE)

( * ) Notice: Subject to any disclaimer, the term of this patent is extended or adjusted under 35 U.S.C. 154(b) by 154 days.

(21) Appl. No.: 17/636,379

(22) PCT Filed: Aug. 19, 2020

(86) PCT No.: PCT/EP2020/073192
§ 371 (c)(1),
(2) Date: Feb. 18, 2022

(87) PCT Pub. No.: WO2021/043576
PCT Pub. Date: Mar. 11, 2021

(65) Prior Publication Data

US 2022/0265118 A1 Aug. 25, 2022

(30) Foreign Application Priority Data

Sep. 4, 2019 (DE) ..... 10 2019 213 456.4

(51) Int. Cl.
*A47L 15/42* (2006.01)

(52) U.S. Cl.
CPC ..... *A47L 15/4293* (2013.01); *A47L 15/4251* (2013.01)

(58) Field of Classification Search
CPC ..... A47L 15/4251; A47L 15/4293
See application file for complete search history.

(56) References Cited

U.S. PATENT DOCUMENTS 3,373,287 A 3/1968 Holzer
8,986,463 B2 * 3/2015 Egger ..... A47L 15/4257 134/56 D
2008/0134728 A1 6/2008 Son
(Continued)

FOREIGN PATENT DOCUMENTS

CN 106498668 A 3/2017
DE 19757809 A1 7/1999
(Continued)

OTHER PUBLICATIONS

International Search Report PCT/EP2020/073192 dated Oct. 22, 2020.

*Primary Examiner* — Benjamin L Osterhout
(74) *Attorney, Agent, or Firm* — Michael E. Tschupp; Andre Pallapies; Brandon G. Braun

(57) ABSTRACT

A household dishwasher includes a dishwasher cavity, a door fastened to the dishwasher cavity and including a panel box, and an operating module provided on the door for operation of the household dishwasher and including a sealing element for sealing the operating module with respect to the panel box. The operating module is pivotable about an axis of rotation from a dismounted state, in which an engagement section of the panel box is not in positive-locking engagement with the operating module into a mounted state, in which the engagement section is in positive-locking engagement with the operating module and the sealing element is pressed between the operating module and the panel box.

17 Claims, 4 Drawing Sheets

(56) References Cited

U.S. PATENT DOCUMENTS

| | | | | |
|---|---|---|---|---|
| 2010/0132749 | A1 | 6/2010 | Buehlmeyer | |
| 2011/0232194 | A1* | 9/2011 | Egger | A47L 15/4293 49/70 |
| 2014/0160643 | A1* | 6/2014 | Gerstner | H05K 5/0017 361/679.01 |

FOREIGN PATENT DOCUMENTS

| | | | |
|---|---|---|---|
| DE | 102004022978 | A1 | 12/2005 |
| DE | 102011007865 | A1 | 10/2012 |
| EP | 0944147 | A1 | 9/1999 |
| WO | 2015188973 | A1 | 12/2015 |

* cited by examiner

DOMESTIC DISHWASHER

CROSS-REFERENCES TO RELATED APPLICATIONS

This application is the U.S. National Stage of International Application No. PCT/EP2020/073192, filed Aug. 19, 2020, which designated the United States and has been published as International Publication No. WO 2021/043576 A1 and which claims the priority of German Patent Application, Serial No. 10 2019 213 456.4, filed Sep. 4, 2019, pursuant to 35 U.S.C. 119(a)-(d).

The contents of International Application No. PCT/EP2020/073192 and German Patent Application, Serial No. 10 2019 213 456.4 are incorporated herein by reference in their entireties as if fully set forth herein.

BACKGROUND OF THE INVENTION

The present invention relates to a household dishwasher.

A dishwasher comprises a dishwasher cavity, in which items that are to be washed and cleaned can be received. A door is rotatably fastened to the dishwasher cavity in order to close and to open the dishwasher cavity. An operating module for operating the dishwasher and/or for displaying operating states of the dishwasher can be received in the door.

The publication EP 1 929 926 A2 describes a dishwasher having a door that has an inner door and an outer door. An operating module for operating the dishwasher is arranged between the inner door and the outer door.

The publication WO 2015/188973 A1 discloses a dishwasher having a door, on which a front panel is provided. An operating module is provided on the front panel and said operating module can be mounted on the front panel with the aid of a pivoting movement.

BRIEF SUMMARY OF THE INVENTION

Against this background, an object of the present invention is to provide an improved household dishwasher.

A household dishwasher is accordingly proposed having a dishwasher cavity, a door that is fastened to the dishwasher cavity and an operating module that is provided on the door so as to operate the household dishwasher. In this case, the door comprises a panel box, wherein the operating module comprises a sealing element for sealing the operating module with respect to the panel box, wherein the operating module can pivot from a dismounted state, in which an engagement section of the panel box is not in positive-locking engagement with the operating module, about an axis of rotation into a mounted state in which the engagement section is in positive-locking engagement with the operating module, and wherein in the mounted state the sealing element is pressed between the operating module and the panel box.

As a consequence of the fact that the operating module can be mounted with the aid of a pivoting movement, it is possible to securely press the sealing element with little expenditure of force so that a sufficient sealing tightness is always ensured between the operating module and the panel box. In comparison with a linear mounting procedure, it is possible to perform the mounting procedure with less mounting force. Moreover, it is possible to reduce the number of engagement sections.

The dishwasher cavity is preferably cuboid. In particular, the dishwasher cavity comprises a base, a lid that is arranged lying opposite the base, a door, a rear wall that is arranged lying opposite the closed door and also two side walls. It is possible to provide receiving arrangements for items that are to be washed in the dishwasher cavity so as to receive items that are to be washed. For example, an upper basket, a lower basket and a cutlery drawer are provided. The door comprises preferably an inner door that is facing a dishwasher interior that is surrounded by the dishwasher cavity, and also an outer door that is facing an area surrounding the household dishwasher. The operating module and the panel box can be arranged between the outer door and the inner door. The fact that the door is "fastened" to the dishwasher cavity is in particular to be understood to mean that the door is pivotably fastened to the dishwasher cavity with the aid of a hinge or multiple hinges.

The operating module can be a display and operating module or can be referred to as such. In particular, in addition to the operation of the household dishwasher the operating module can also be suitable for the purpose of displaying operating states of the household dishwasher, such as for example the time remaining of a washing program. The panel box is preferably a plastic component. In particular, the panel box can be a plastic injection molded component. The panel box can be a single-piece component or can be constructed from multiple components that are connected to one another. "Single-piece" in the present case means that the panel box is formed from only one component and is not combined from multiple individual components. As mentioned above, the construction of the panel box is however arbitrary.

The term a "positive-locking engagement" in the present case is to be understood to mean a connection that can be achieved by the engagement in or engagement behind at least two connecting partners, in the present case the engagement section and the operating module. A positive-locking connection is detachable. This means that the operating module can also be returned from the mounted state into the dismounted state. "Not in positive-locking engagement" accordingly means that the engagement section and the operating module are not in engagement with one another. It is particularly preferred that two engagement sections are provided. The fact that in the mounted state the sealing element is "pressed" is in particular to be understood to mean that the sealing element is deformed in an elastic manner, in particular resilient elastic manner, in the mounted state in comparison with the dismounted state.

The door of the household dishwasher is in particular allocated an x-direction or depth direction, a y-direction or height direction and a z-direction or width direction. The directions are positioned perpendicularly with respect to one another. In particular, the above-mentioned axis of rotation viewed in the height direction is arranged above the engagement section or the engagement sections. The axis of rotation in particular extends in or parallel to the width direction. The operating module can in particular be operated from an end face of the door. The end face is spanned by the depth direction and the width direction. This means that an operation of the operating module is provided preferably along the height direction and not along the width direction or the depth direction. The end face can be an end face lid of the panel box.

In accordance with one embodiment, the operating module has mounting elements that are mounted in corresponding receiving sections of the panel box in order to pivot the operating module about the axis of rotation.

The receiving sections can be recesses that are provided in the panel box and it is possible to receive the mounting elements in said recesses. The mounting elements and the receiving sections render it possible for the operating module to pivot about the axis of rotation. It is preferred that two mounting elements are provided such that they are arranged spaced from one another in the width direction. Accordingly, it is preferred that two receiving sections are also provided such that they are spaced from one another in the width direction. It is particularly preferred however that four mounting elements are provided. Accordingly, it is also possible to provide four receiving sections.

In accordance with one further embodiment, the mounting elements in each case have an axis section, about which the operating module can pivot from the dismounted state into the mounted state.

The axis section can be for example cylindrical. The axis section can also have any other arbitrary geometry. The axis section defines the axis of rotation, about which the operating module on the panel box can pivot.

In accordance with one further embodiment, the engagement section of the panel box is a snap-in hook that engages behind the operating module in the mounted state at least in sections in a positive-locking manner.

It is preferred that multiple engagement sections are provided. It is particularly preferred that two engagement sections are provided that are arranged spaced from one another in the width direction. The two engagement sections engage behind the operating module synchronously or snap behind said operating module synchronously. "Synchronously" in this case means simultaneously.

In accordance with one further embodiment, the operating module has an operating module housing and an electronic operating and display system that is received in the operating module housing.

The operating module housing is preferably a plastic component. For example, the operating module housing can be a plastic injection molded component. The operating module housing can be provided as a single-piece, in particular as one piece of material. "One piece of material" in this case means that the operating module housing is produced throughout from the same material. The electronic operating and display system can comprise a circuit board having electronic components that are mounted thereon. The electronic components can comprise for example light-emitting diodes, microprocessors, switches or the like.

In accordance with a further embodiment, the sealing element is fixedly connected to the operating module housing, in particular is injected onto said operating module housing with the aid of a plastic injection molding process.

It is particularly preferred that the sealing element is connected in a materially bonded manner to the operating module housing. In the case of materially bonded connections, the connecting partners are held together by atomic or molecular forces. Materially bonded connections are non-detachable connections that can only be separated by destroying the connecting means and/or the connecting partner. For example, the sealing element is adhesively bonded to the operating module housing. Alternatively, the sealing element can also be injected directly onto the operating module housing with the aid of a plastic injection molding process. In this case, the operating module housing can be produced for example with the aid of a two-component injection molding process. The sealing element can be provided as a sealing lip. It is particularly preferred that the sealing element comprises multiple sealing lips that are arranged spaced from one another. For example, it is possible to provide two sealing lips. The sealing element is preferably produced from an elastically deformable plastic.

In accordance with one further embodiment, the operating module housing has an upper side that is inclined in the direction of the sealing element.

The electronic operating and display system that is to be protected against moisture is arranged under the upper side. In particular, the upper side has a negative incline from the inner door in the direction of the outer door. This means that the upper side slopes downwards from the inner door in the direction of the outer door. The upper side guides liquid that has penetrated into the door toward the sealing element.

In accordance with a further embodiment, the operating module housing has a dividing wall that extends beyond the upper side.

In particular, the dividing wall extends along the height direction. The dividing wall and the upper side are provided as a single piece, in particular "one piece of material".

In accordance with a further embodiment, in the mounted state the dividing wall is arranged between two sealing walls of the panel box that are arranged spaced from one another with the result that the dividing wall and the sealing walls provide a labyrinth sealing arrangement.

An intermediate space is provided between the sealing walls and in the mounted state the dividing wall is arranged in said intermediate space. When the operating module is brought from the dismounted state into the mounted state, the dividing wall pivots into this intermediate space in order to provide the labyrinth sealing arrangement. The labyrinth sealing arrangement prevents a penetration of liquid between the panel box and the inner door.

In accordance with a further embodiment, an actuating button is guided through an opening that is provided in the upper side.

In particular, a large number of actuating buttons and accordingly a large number of openings are provided. With the aid of the actuating button, it is possible for example to actuate a switch that is provided on the circuit board of the electronic display and operating system. Moreover, the upper side can also have one or multiple openings for a light conductor that is suitable for guiding light from a light-emitted diode, which is provided on the circuit board of the electronic display and operating system, through the operating element housing.

In accordance with a further embodiment, a dividing wall that surrounds the opening is provided on the upper side.

The dividing wall can have for example a rectangular geometry or a cylindrical geometry. A dividing wall of this type is allocated to each opening. It is possible to provide such a dividing wall for the above-mentioned light conductor. The dividing wall prevents liquid penetrating through the opening. The dividing wall guides the liquid around the opening.

In accordance with a further embodiment, a sealing mat is placed on the upper side and said sealing mat prevents liquid penetrating through the opening.

The sealing mat prevents the liquid penetrating in the height direction. Liquid that penetrates between the sealing mat and the upper side is guided around the opening with the aid of the dividing wall of the opening.

In accordance with a further embodiment, the actuating button is embodied as a single piece, in particular as one piece of material, with the sealing mat.

The sealing mat is preferably produced from an elastically deformable material. For example, the sealing mat can be produced from silicon or from a thermoplastic elastomer (TPE), in particular a thermoplastic polyurethane (TPU). The actuating button is provided as bar-shaped and is guided through the opening. The actuating button can have for example a circular or a rectangular cross section. The sealing mat preferably has a plate shape base section and the actuating button is molded on said base section as a single piece, in particular as one piece of material.

In accordance with a further embodiment, the panel box has a liquid discharge opening, wherein the liquid discharge opening is provided on the outer door side.

"Outer door side" in the present case means that the liquid discharge opening is facing the outer door. With the aid of the inclined upper side of the operating module housing, the liquid is guided to the liquid discharge opening. The liquid can then drain and evaporate between the panel box and the outer door.

In accordance with a further embodiment, a large number of liquid discharge openings are provided, which are placed adjacent to one another in a row.

The number of liquid discharge openings is arbitrary. The liquid discharge openings can have an arbitrary cross section. For example, the liquid discharge openings can be circular. The liquid discharge openings can however also be rectangular. "In a row" means in this case in particular that the liquid discharge openings viewed in the height direction are all placed at the same height.

Further possible implementations of the household dishwasher also comprise combinations, which are not explicitly mentioned, of features or embodiments that are described above or below in relation to the exemplary embodiments. In this case, the person skilled in the art will also add individual aspects as improvements or additions to the respective basic form of the household dishwasher.

BRIEF DESCRIPTION OF THE DRAWINGS

Further advantageous embodiments and aspects of the household dishwasher are the subject matter of the dependent claims and also the exemplary embodiments of the household dishwasher that are described below. The household dishwasher is further explained below with the aid of preferred embodiments with reference to the attached figures.

DETAILED DESCRIPTION OF EXEMPLARY EMBODIMENTS OF THE PRESENT INVENTION

Figure 1:
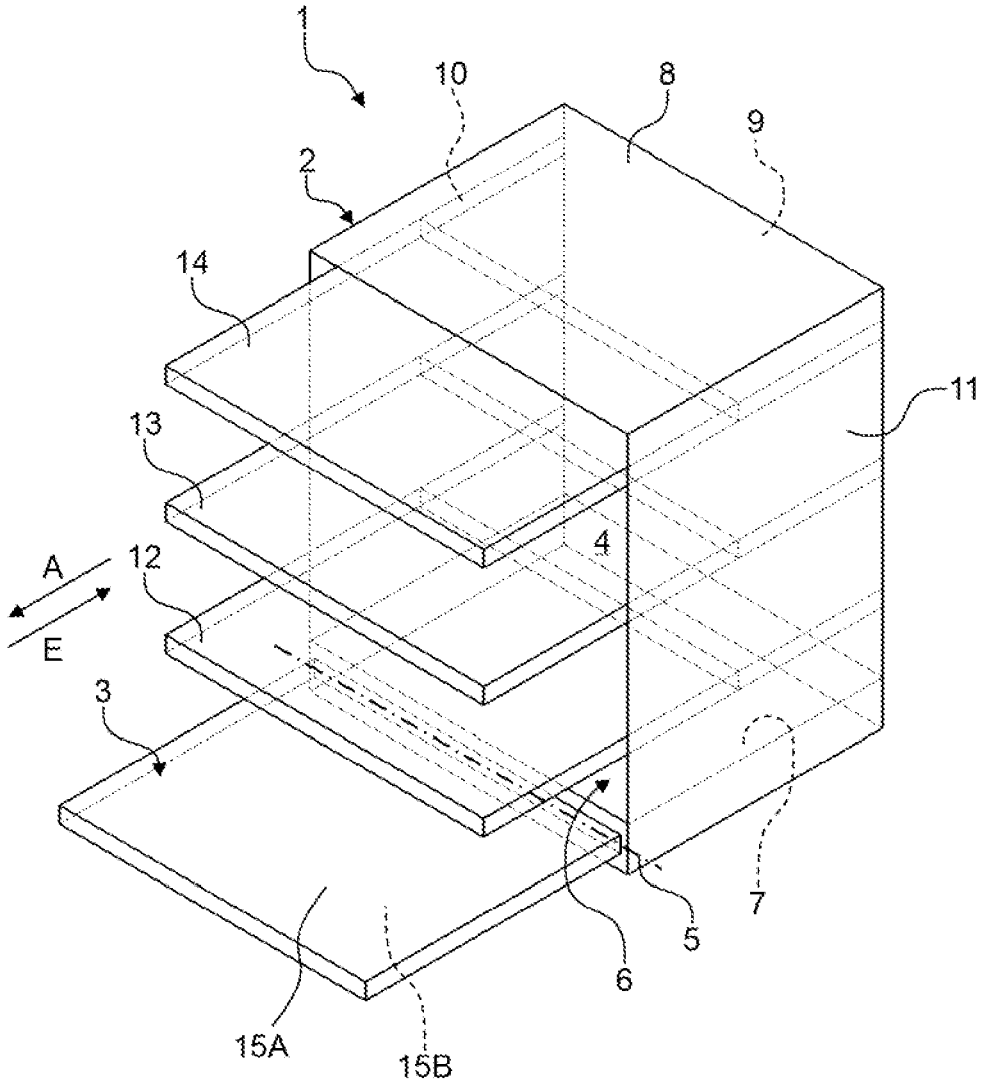
FIG. 1 shows a schematic perspective view of an embodiment of a household dishwasher.

Identical or functionally identical elements in the figures have been provided with the same reference characters provided that nothing different is indicated.

FIG. 1 illustrates a schematic perspective view of an embodiment of a household dishwasher 1. The household dishwasher 1 comprises a dishwasher cavity 2 that can be closed by a door 3, in particular in a watertight manner. For this purpose, it is possible to provide a sealing device between the door 3 and the dishwasher cavity 2. The dishwasher cavity 2 is preferably cuboid. The dishwasher cavity 2 can be arranged in a housing of the household dishwasher 1. The dishwasher cavity 2 and the door 3 can form a dishwasher interior 4 for washing items that are to be washed.

The door 3 is illustrated in FIG. 1 in its opened position. The door 3 can be closed or opened by pivoting about a pivoting axis 5 that is provided on a lower end of the door 3. A loading hatch 6 of the dishwasher cavity 2 can be closed or opened with the aid of the door 3. The dishwasher cavity 2 has a base 7, a lid 8 that lies opposite the base 7, a rear wall 9 that lies opposite the closed door 3 and two side walls 10, 11 that are arranged lying opposite one another. The base 7, the lid 8, the rear wall 9 and the side walls 10, 11 can be produced for example from a stainless steel plate. Alternatively, for example the base 7 can be produced from a plastic material.

The household dishwasher 1 moreover has at least one receiving arrangement 12 to 14 for receiving items that are to be washed. It is preferred that multiple, for example three, receiving arrangements 12 to 14 for receiving items to be washed are provided, wherein the receiving arrangement 12 for receiving items to be washed can be a lower receiving arrangement for receiving items to be washed or a lower basket, the receiving arrangement 13 for receiving items to be washed can be an upper receiving arrangement for receiving items to be washed or an upper basket and the receiving arrangement 14 for receiving items to be washed can be a cutlery drawer. As is furthermore illustrated in FIG. 1, the receiving arrangements 12 to 14 for receiving items to be washed are arranged one above the other in the dishwasher cavity 2. Each receiving arrangement 12 to 14 for receiving items to be washed can be selectively shifted into or out of the dishwasher cavity 2. In particular, each receiving arrangement 12 to 14 for receiving items to be washed can be slid into or pushed into the dishwasher cavity 2 in a direction of insertion E and can be slid out or pulled out from the dishwasher cavity 2 opposite the direction of insertion E in a direction of extraction A.

As is further apparent from FIG. 1, the door 3 comprises an inner door 15A that faces the dishwasher interior 4 and also an outer door 15B that is remote from the dishwasher interior 4. The inner door 15A and the outer door 15B can be spaced from one another and can be arranged parallel with respect to one another. A panel box that is not illustrated in FIG. 1 and having an operating module of the household dishwasher 1 can be provided between the inner door 15A and the outer door 15B.

Figure 2:
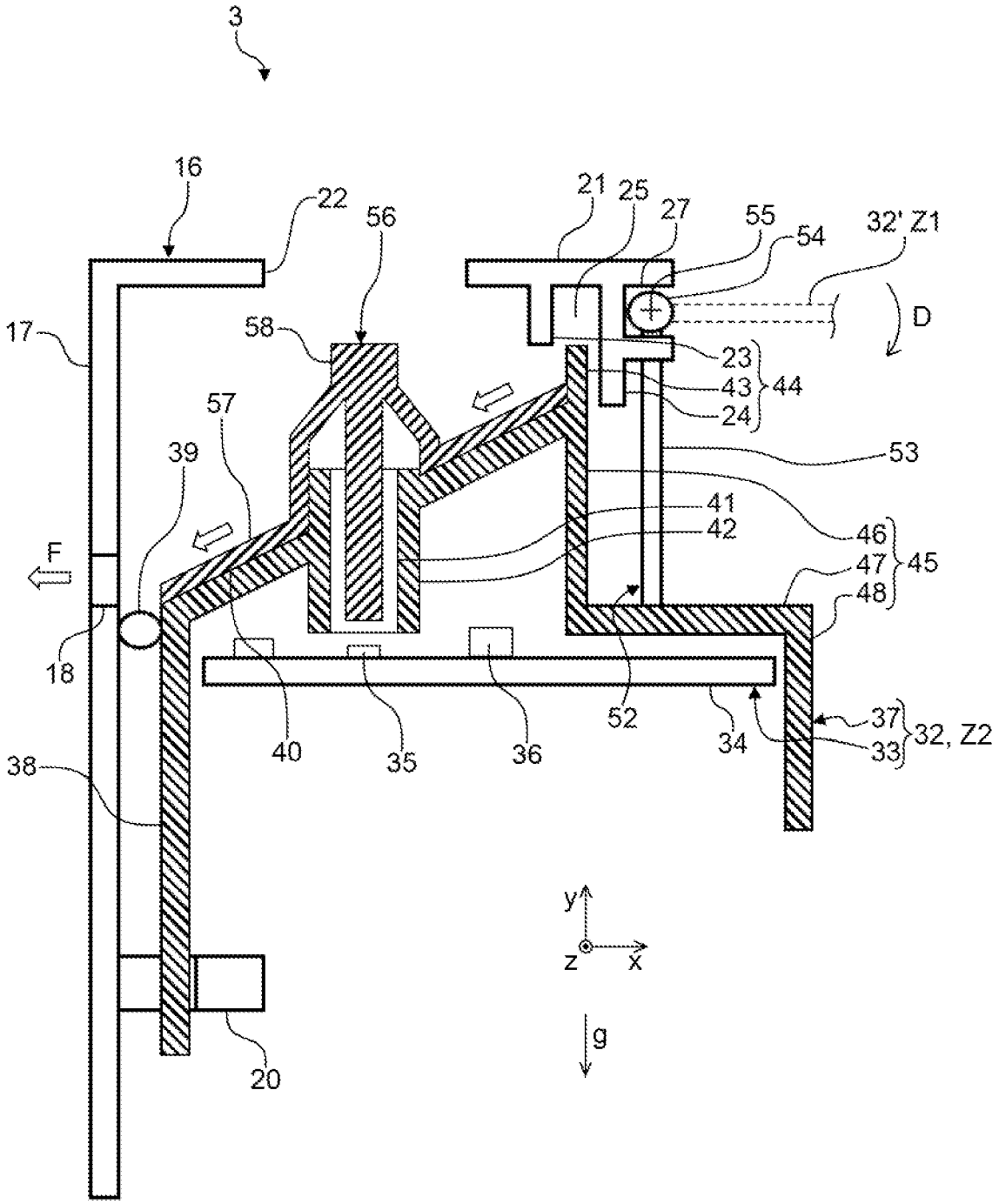
FIG. 2 shows a schematic part sectional view of an embodiment of a door for the household dishwasher in accordance with FIG. 1.

FIG. 2 illustrates a schematic part sectional view of an embodiment of a door 3 as mentioned above. The door 3 is allocated a coordinate system having an x-direction or depth direction x, a y-direction or height direction y and a z-direction or width direction z. The directions x, y, z are positioned perpendicularly with respect to one another. The height direction y can be oriented parallel with respect to a direction of gravitational force g. The direction of gravitational force g is oriented from above downward in the orientation of FIG. 2. In FIG. 2, the door 3—in contrast with FIG. 1—is illustrated in its closed state.

Figure 3:
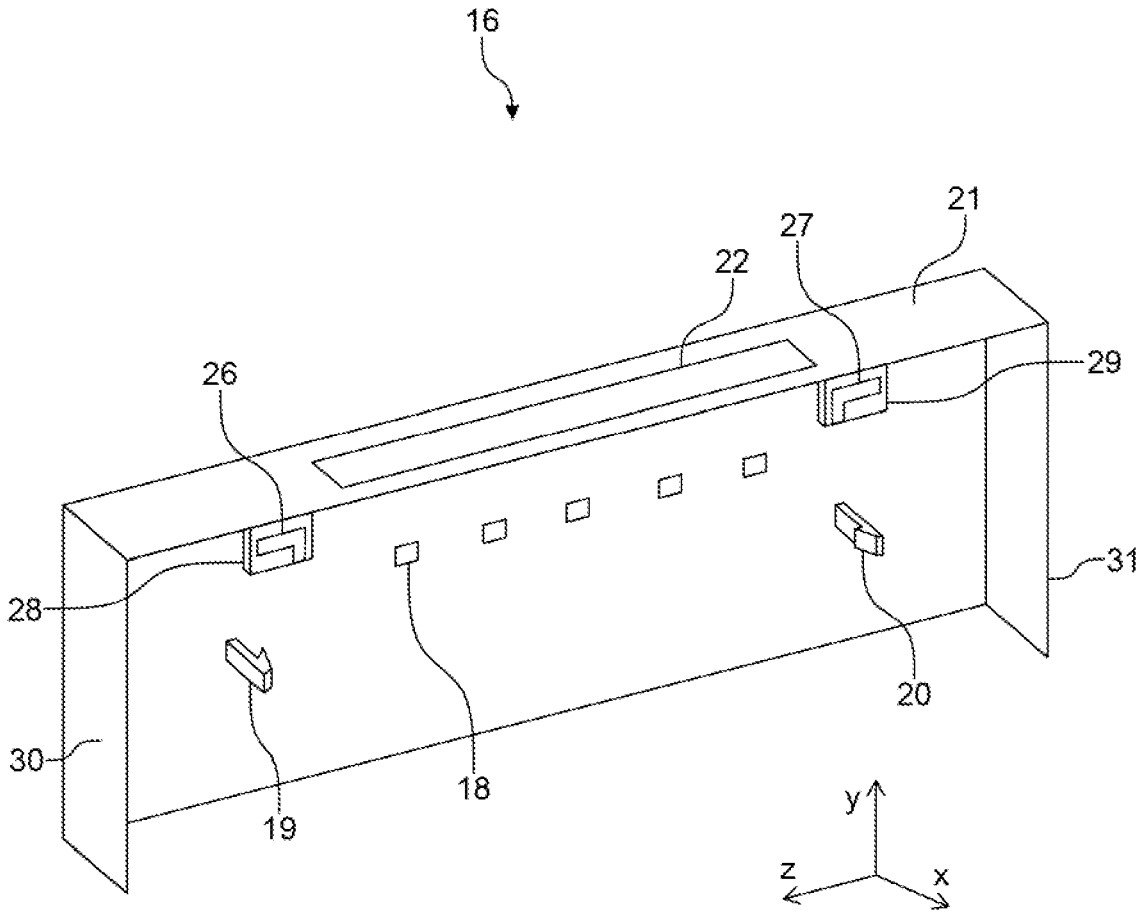
FIG. 3 shows a schematic perspective view of an embodiment of a panel box for the household dishwasher in accordance with FIG. 1.

The door 3 comprises a panel box 16 that is arranged in the orientation of FIG. 2 on the upper side on the door 3 and said panel box is illustrated again in FIG. 3 in a schematic perspective view. The panel box 16 is preferably a plastic component. For example, the panel box 16 can be a plastic injection molded component. The panel box 16 can be a single piece or can be combined from multiple individual components. "Single piece" in the present case means that the panel box 16 can be a single component that is not constructed from multiple individual components. As mentioned above, the panel box 16 alternatively however can also be combined from multiple individual components.

The panel box 16 comprises a front wall 17 that faces the outer door 15B. The front wall 17 comprises a large number of liquid discharge openings 18 and the liquid F, for example water, that penetrates into the door 3 can discharge through said liquid discharge openings in the direction of the outer door 15B. The liquid F can then flow for example downward along the front wall 17 opposite the direction of gravitational force g. It is preferred that a large number of liquid discharge openings 18 of this type are provided and, as is illustrated in FIG. 3, said liquid discharge openings can be positioned adjacent to one another in a row. The liquid discharge openings 18 are provided on the outer door side. This means that the liquid discharge openings 18 face the outer door 15B.

At least one engagement section 19 is provided on the front wall 17 on the rear side, in other words remote from the outer door 15B. It is particularly preferred however that two engagement sections 19, 20 are provided that are arranged spaced from one another in the width direction z. The engagement sections 19, 20 are provided as snap-in hooks. The engagement sections 19, 20 can deform in a resilient-elastic manner. The panel box 16 furthermore comprises a lid 21 having a rectangular opening 22 that extends along the width direction z.

In the orientation of FIG. 2, two sealing walls 23, 24 that are arranged spaced from one another in the depth direction x extend downward from the lid 21. A slot-shaped intermediate space 25 is provided between these sealing walls 23, 24. Receiving sections 26, 27 can be provided on the sealing wall 24 and the function of said receiving sections is further explained below. The receiving sections 26, 27 can be for example rectangular or L-shaped recesses. The receiving sections 26, 27 can be provided on the sealing wall 24 or on bulges 28, 29 that are illustrated in FIG. 3. The panel box 16 furthermore has two side walls 30, 31 that are spaced from one another in the width direction z.

Figure 4:
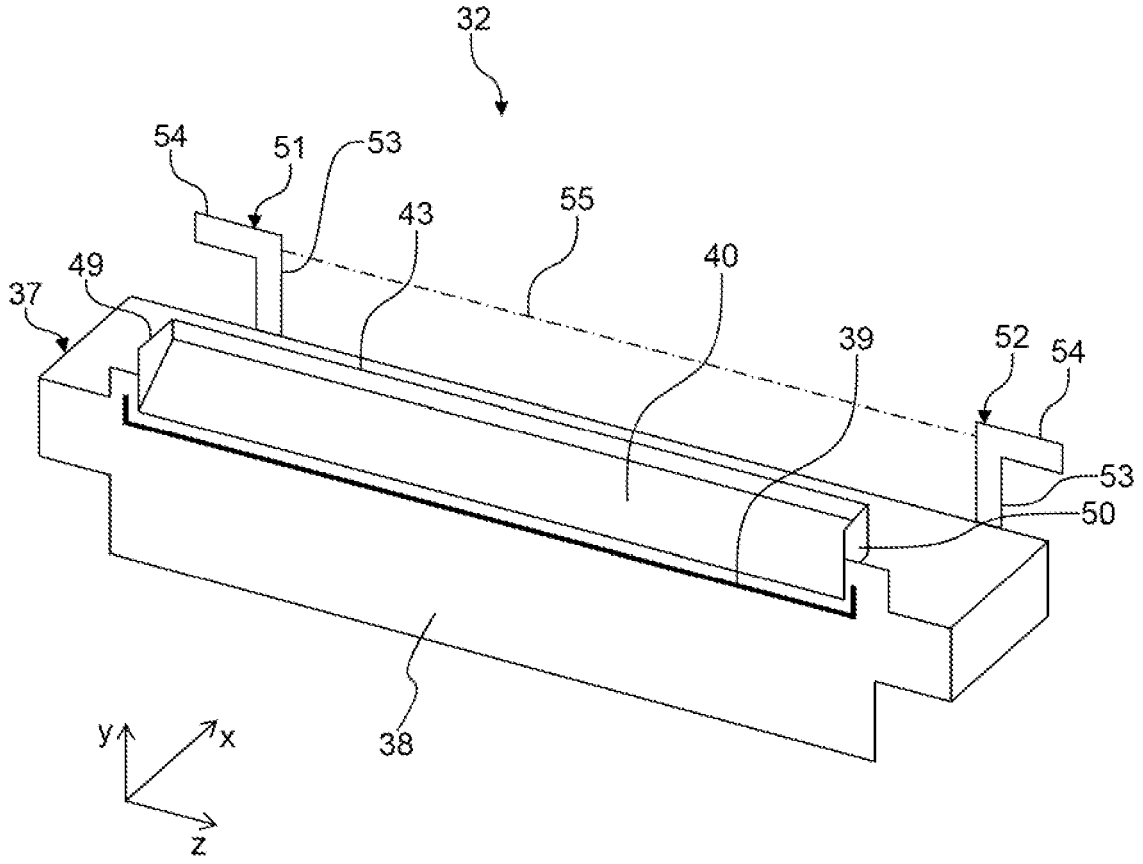
FIG. 4 shows a schematic perspective view of an embodiment of an operating module for the household dishwasher in accordance with FIG. 1.

The door 3 furthermore comprises an operating module 32 for operating the household dishwasher 1. The operating module 32 is illustrated in FIG. 4 in a schematic perspective view. The operating module 32 can also be suitable for displaying operating states of the household dishwasher 1. For this purpose, the operating module 32 can comprise for example light-emitting diodes (LED) and/or other display elements. The operating module 32 can also be referred to as a display and operating module.

The operating module 32 comprises an electronic operating and display system 33 that can have for example a circuit board 34 and also electronic components that are mounted on said circuit board. The electronic components can comprise for example switches 35, light-emitting diodes 36 or the like. The electronic operating and display system 33 is received in an operating module housing 37 of the operating module 32.

The operating module housing 37 can be a plastic component. In particular, the operating module housing 37 can be a plastic injection molded component. The operating module housing 37 comprises a front wall 38 that faces the front wall 17 of the panel box 16. The engagement sections 19, 20 are suitable for engaging in a positive-locking manner behind the operating module 32, in particular the front wall 38 of the operating module housing 37. In this case, the engagement sections 19, 20 snap into or behind the front wall 38. A positive-locking connection is provided by the engagement into one another or behind at least two connecting partners, in the present case the engagement sections 19, 20 and the operating module 32. Positive-locking connections are detachable connections.

Furthermore, a sealing element 39 is provided on the front wall 38. The sealing element 39 can have an oval or circular cross section. The sealing element 39 can also be lip-shaped or can have a sealing lip. In particular, the sealing element 39 can have multiple, for example two sealing lips. The sealing element 39 is suitable for sealing the operating module housing 37 in a fluid-tight manner with respect to the panel box 16. The sealing element 39 is fixedly connected to the front wall 38. For example, the sealing element 39 is injected in a plastic injection molding process onto the operating module housing 37. The sealing element 39 can be produced for example from a thermoplastic elastomer (TPE), in particular from a thermoplastic polyurethane (TPU). The sealing element 39 can also be produced from a silicone material. The sealing element 39 can deform in an elastic manner, in particular in a resilient elastic manner. For example, the sealing element 39 can be produced from a foamed plastic material.

An upper side 40 that is inclined in the direction of the sealing element 39 connects to the front wall 38. The upper side 40 is provided with a negative incline from an inner side of the door 3, which the inner door 15A is allocated to, in the direction of an outer side of the door 3, which the outer door 15B is allocated to, with the result that liquid F that drains on the upper side 40 is guided in the direction of the sealing element 39.

The upper side 40 can have a large number of openings 41. However only one opening 41 is discussed below. A dividing wall 42 runs around the opening 41 and said dividing wall prevents the liquid F penetrating through the opening 41. The dividing wall 42 can be provided for example in a rectangular or cylindrical manner. The dividing wall 42 extends in the height direction y beyond the upper side 40.

A dividing wall 43 that extends in the height direction y connects to the upper side 40. The dividing wall 43 is arranged in the intermediate space 25 and together with the sealing walls 23, 24 forms a labyrinth sealing arrangement 44. On the underside, a rear wall 45 of the operating module housing 37 extends from the upper side 40 in extension of the dividing wall 43. The rear wall 45 has multiple parts and comprises a first wall section 46 that is a continuation of the dividing wall 43, a second wall section 47 that is arranged perpendicularly with respect to the first wall section 46 and a third wall section 48 that is arranged perpendicularly with respect to the second wall section 47. The operating module housing 37 furthermore comprises two side walls 49, 50.

Two mounting elements 51, 52 extend from the second wall section 47 in the height direction y and are spaced from one another in the width direction z. It is however also possible to provide four mounting elements 51, 52. The mounting elements 51, 52 are suitable for being received in the receiving sections 26, 27 of the panel box 16. For the event that four mounting elements 51, 52 are provided, four receiving sections 26, 27 are also accordingly provided. Each mounting element 51, 52 comprises a web section 53 that extends in the height direction from the second wall section 47 and also an axis section 54 that is arranged on the end side on the web section 53 and the operating module 32 on the panel box 16 can rotate about said axis section. The axis sections 54 of the mounting elements 51, 52 realize an axis of rotation 55, about which the operating module 32 on the panel box 16 can rotate. The axis sections 54 are cylindrical, in particular circular cylindrical, as is illustrated in FIG. 2. The axis sections 54 can however also have other suitable geometries. The mounting elements 51, 52 having the axis sections 54 are illustrated only in a particularly heavily schematized manner.

The door 3 furthermore comprises a sealing mat 56 that is placed on the upper side 40 in order to prevent liquid F penetrating into the opening 41 of the upper side 40. The sealing mat 56 comprises a plate-shaped base section 57 that is placed on the upper side 40. Moreover, the sealing mat 56 comprises an actuating button 58 for actuating the switch 35. The actuating button 58 is guided through the opening 41. In this case, the actuating button 58 is provided as a single part, in particular as one piece of material, with the base section 57 of the sealing mat 56. "One piece of material" in the present case means that the actuating button 58 and the base section 57 are produced throughout from the same material. The sealing mat 56 can be produced for example from silicone, from a TPE, in particular from a TPU, or from another suitable material.

The functionality of the door 3 is explained below. In order to mount the operating module 32 on the panel box 16, the axis sections 54 of the mounting elements 51, 52 are inserted into the receiving sections 26, 27 of the panel box 16. This state of the operating module 32 is referred to as the dismounted state Z1 that is illustrated in FIG. 2 with dashed lines. In the dismounted state Z1, only the mounting element 52 of the operating module that is referred to with the reference character 32' is illustrated in FIG. 2.

Subsequently, the operating module 32' pivots about the axis of rotation 55 in a direction of rotation D that in the orientation of FIG. 2 orients in the clockwise direction toward the front wall 17 of the panel box 16. In particular, the operating module 32' pivots about 90°. In this case, the engagement sections 19, 20 snap into the operating module 32 with the result that this operating module is connected to the panel box 16 in a positive-locking manner. Moreover, the sealing element 39 is deformed in an elastic manner. The operating module 32 is located in a mounted state Z2. In the mounted state Z2, the sealing element 39 is pressed between the operating module 32, in particular the front wall 38 of the operating module housing 37, and the panel box 16, in particular the front wall 17 of the panel box 16.

During operation of the household dishwasher 1, for example liquid F that penetrates through the opening 22 is drained on the inclined upper side 40 in the direction of the sealing element 39 and is discharged through the liquid discharge openings 18. A passage of the liquid F in the orientation of FIG. 2 toward the right, in other words in the direction of the inner door 15A is prevented with the aid of the labyrinth seal 44. It is possible that liquid F that passes under the sealing mat 56 is guided with the aid of the dividing wall 42 around the opening 41, said liquid discharges between the upper side 40 and the base section 57 of the sealing mat 56 and is guided to the sealing element 39. From the sealing element 39, the liquid F is discharged through the liquid discharge openings 18.

On account of the pivoting movement when the operating module 32 is mounted, the pressing force for pressing the sealing element 39 can be reduced. The number of engagement sections 19, 20 of the panel box 16 can likewise be reduced. It is consequently possible to achieve a reduced mounting force without additional mounting tools. The position of the individual components of the door 3 is always exactly defined.

Although the present invention has been described with reference to exemplary embodiments, the invention can be modified in diverse ways.

The invention claimed is:

1. A household dishwasher, comprising:

a dishwasher cavity;

a door fastened to the dishwasher cavity and comprising a panel box; and an operating module provided on the door for operation of the household dishwasher and comprising a sealing element for sealing the operating module with respect to the panel box, said operating module designed to pivot about an axis of rotation from a dismounted state, in which an engagement section of the panel box is not in positive-locking engagement with the operating module, into a mounted state, in which the engagement section engages behind a front wall of the operating module in a positive-locking manner and the sealing element is pressed between the operating module and the panel box.

2. The household dishwasher of claim 1, wherein the operating module comprises mounting elements mounted in corresponding receiving sections of the panel box in order to pivot the operating module about the axis of rotation.

3. The household dishwasher of claim 2, wherein the mounting elements each include an axis section, about which the operating module is pivotable from the dismounted state into the mounted state.

4. The household dishwasher of claim 1, wherein the engagement section of the panel box is a snap-in hook that engages behind the front wall of the operating module.

5. The household dishwasher of claim 1, wherein the operating module comprises an operating module housing and an electronic operating and display system that is received in the operating module housing.

6. The household dishwasher of claim 5, wherein the sealing element is fixedly connected to the operating module housing.

7. The household dishwasher of claim 6, wherein the sealing element is injected onto the operating module housing by a plastic injection molding process.

8. The household dishwasher of claim 5, wherein the operating module housing includes an upper side that is inclined in a direction of the sealing element.

9. The household dishwasher of claim 8, wherein the operating module housing includes a dividing wall that extends beyond the upper side.

10. The household dishwasher of claim 9, wherein in the mounted state the dividing wall is arranged between two sealing walls of the panel box that are arranged spaced from one another such that the dividing wall and the sealing walls provide a labyrinth sealing arrangement.

11. The household dishwasher of claim 8, further comprising an actuating button guided through an opening in the upper side of the operating module housing.

12. The household dishwasher of claim 11, wherein the operating module housing includes a dividing wall on the upper side in surrounding relation to the opening.

13. The household dishwasher of claim 11, further comprising a sealing mat placed on the upper side to prevent liquid penetrating through the opening.

14. The household dishwasher of claim 13, wherein the actuating button is embodied as a single piece with the sealing mat.

15. The household dishwasher of claim 13, wherein the actuating button is embodied in one piece of material with the sealing mat.

16. The household dishwasher of claim 1, wherein the panel box includes a liquid discharge opening on an outer side of the door.

17. The household dishwasher of claim 1, wherein the panel box includes a number of liquid discharge openings placed adjacent to one another in a row on an outer side of the door.

* * * * *